US008275276B2

(12) United States Patent
Fukuta

(10) Patent No.: US 8,275,276 B2
(45) Date of Patent: Sep. 25, 2012

(54) IMAGE FORMING DEVICE HAVING CHARGER AND METHOD OF CONTROLLING VOLTAGE APPLICATION TO CHARGER

(75) Inventor: Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 428 days.

(21) Appl. No.: 12/625,055

(22) Filed: Nov. 24, 2009

(65) Prior Publication Data

US 2010/0129097 A1 May 27, 2010

(30) Foreign Application Priority Data

Nov. 27, 2008 (JP) ..... 2008-302343

(51) Int. Cl.
*G03G 15/02* (2006.01)
*G03G 15/06* (2006.01)

(52) U.S. Cl. ..... 399/50; 399/55

(58) Field of Classification Search ..... 399/127, 399/128, 50, 53, 55
See application file for complete search history.

(56) References Cited

U.S. PATENT DOCUMENTS 5,835,821 A * 11/1998 Suzuki et al. ..... 399/50
6,324,357 B1 11/2001 Gomi et al.
6,564,023 B2 * 5/2003 Takami et al. ..... 399/50
7,463,850 B2 12/2008 Itabashi
7,542,689 B2 * 6/2009 Ida et al. ..... 399/50
7,555,232 B2 * 6/2009 Imura ..... 399/55
2003/0235419 A1 * 12/2003 Ota ..... 399/50
2010/0221026 A1 * 9/2010 Komatsu ..... 399/50

FOREIGN PATENT DOCUMENTS

JP 07-261517 10/1995
JP 09-190143 7/1997
JP 09-319188 12/1997
JP 2001-013745 A 1/2001
JP 2001-013849 1/2001
JP 2005-338320 A 12/2005
JP 2006-039139 2/2006

OTHER PUBLICATIONS

JP Office Action dtd Aug. 10, 2010, JP Appln. 2008-302343, English transation.

* cited by examiner

*Primary Examiner* — Susan Lee
(74) *Attorney, Agent, or Firm* — Banner & Witcoff, Ltd.

(57) ABSTRACT

An image forming device includes a photosensitive member, a charger, an exposing unit, a developing unit and a control unit. The charger charges the photosensitive member, and the exposing unit exposes the photosensitive member to light and forms an electrostatic latent image on the photosensitive member. The developing unit develops the electrostatic latent image formed and has a developing member having a surface potential and developer charged to a polarity. The control unit applies a first voltage having a first absolute value to the charger at least during development while applying a second voltage having a second absolute value to the charger during operations other than development. The first voltage, the second voltage and the surface potential have the same polarity as the developer with the first voltage absolute value being greater than the second voltage absolute value which is greater than an absolute value of the surface potential.

12 Claims, 5 Drawing Sheets

IMAGE FORMING DEVICE HAVING CHARGER AND METHOD OF CONTROLLING VOLTAGE APPLICATION TO CHARGER

CROSS REFERENCE TO RELATED APPLICATION

This application claims priority from Japanese Patent Application No. 2008-302343 filed Nov. 27, 2008. The entire content of the priority application is incorporated herein by reference.

TECHNICAL FIELD

The present invention relates to an electrophotographic image forming device and also to a method of controlling such an image forming device.

BACKGROUND

In a conventional electrophotographic image forming device, an electrostatic latent image is formed on a surface of a photosensitive drum after the surface is charged and then exposed to light. Toner is subsequently supplied to the electrostatic latent image, thereby forming a visible toner image to be transferred onto sheets. For charging the surface of the photosensitive drum, there has been used a charger, such as a charging wire for generating a corona discharge.

When rotating the photosensitive drum for the purpose of warming up or cleaning, a voltage is applied to the charger (charging member) for making the surface of the photosensitive drum charged with a potential higher than that of a developing roller in order to prevent toner adhesion to the photosensitive drum. The voltage applied to the photosensitive drum for a purpose other than development is conventionally the same as a voltage applied for development, which has a relatively high absolute value. As a result, given a fact that the life of the charging member is dependent on the level of voltage applied thereto, continuous applications of such a high voltage to the photosensitive drum may result in encouraging adherence of foreign materials to the charging member, thereby leading to a malfunction of the charging member and a shorter life of the charging member.

SUMMARY

In view of the foregoing, it is an object of the present invention to provide an image forming device capable of prolonging life of a charging member, and a method of controlling the image forming device.

In order to attain the above and other objects, there is provided an image forming device including a photosensitive member, a charger, an exposing unit, a developing unit and a control unit. The charger charges the photosensitive member at a charging position. The exposing unit exposes the photosensitive member to light and forms an electrostatic latent image on the photosensitive member. The developing unit develops the electrostatic latent image formed on the photosensitive member at a developing position, the developing unit having a developing member that carries thereon developer charged to a polarity, the developing member having a surface potential. The control unit controls the charger so that a first voltage having a first absolute value and a second voltage having a second absolute value are selectively applied to the charger, the first absolute value being greater than the second absolute value, the surface potential of the developing member having a third absolute value smaller than the second absolute value, the control unit applying the first voltage to the charger at least during development while applying the second voltage to the charger during operations other than development, the first voltage, the second voltage and the surface potential having a polarity same as the polarity of the developer.

According to another aspect of the present invention, there is provided a method for controlling operations of an image forming device. The image forming device includes a photosensitive member; a charger that charges the photosensitive member at a charging position; an exposing unit that exposes the photosensitive member to light and forms an electrostatic latent image on the photosensitive member; and a developing unit that develops the electrostatic latent image formed on the photosensitive member at a developing position, the developing unit having a developing member that carries developer thereon, the developing member having a surface potential, the developer being charged to a polarity. The method for controlling the image forming device includes: applying a first voltage to the charger at least during development, the first voltage having a first absolute value; and applying a second voltage to the charger during operations other than development, the second voltage having a second absolute value smaller than the first absolute value, the surface potential of the developing member having a third absolute value smaller than the second absolute value, the first voltage, the second voltage and the surface potential having a polarity same as the polarity of the developer.

DETAILED DESCRIPTION

First, a general configuration of a laser printer 1 according to an embodiment of the present invention will be described with reference to FIG. 1. Note that, in the following description, orientations are referred to assuming that the laser printer 1 is disposed in an orientation in which it is intended to be used. In other words, the right side of the laser printer 1 in FIG. 1 will be referred to as a "front side", while the left side of the printer 1 in FIG. 1 will be referred to as a "rear side." Also, the near side in FIG. 1 with respect to the paper width direction will be referred to as a "left side", while the far side in FIG. 1 will be referred to as a "right side."

Figure 1:
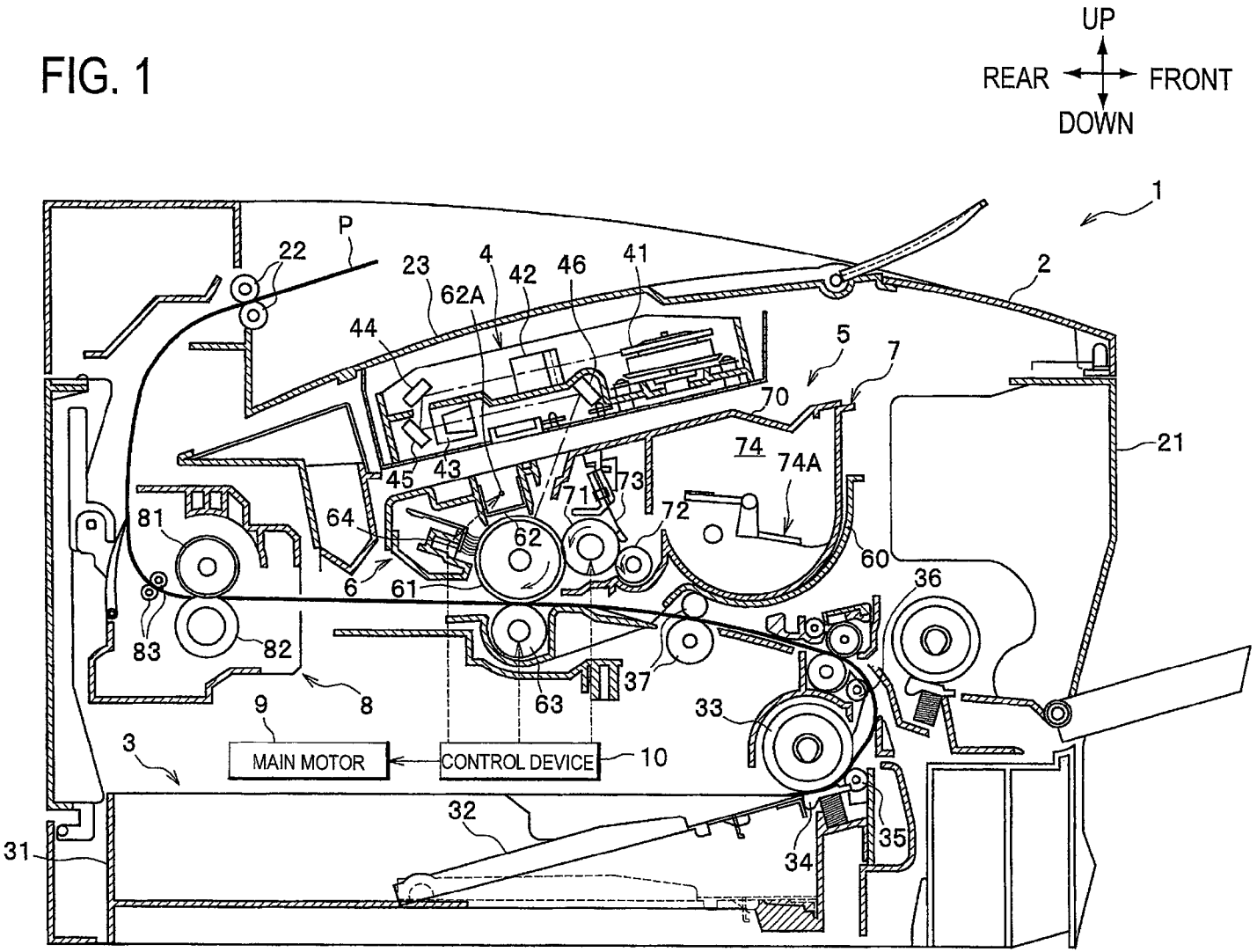
FIG. 1 is a cross-sectional view illustrating an entire configuration of a laser printer according to an embodiment of the present invention.

As shown in FIG. 1, the laser printer 1 is a monochrome printer that includes a main casing 2. Within the main casing 2 disposed are a sheet accommodation section 3, an exposure device 4, a process cartridge 5, a fixing section 8, a main motor 9 and a control device 10. The laser printer 1 is formed with an opening at the front side thereof, and a front cover 21 is pivotably movably provided on the main casing 2 for covering the opening. A sheet discharge tray 23 is formed on an upper surface of the laser printer 1.

The sheet accommodation section 3 is disposed in a lower portion of the main casing 2. The sheet accommodation section 3 includes a sheet tray 31 that accommodates sheets P in a stacked state, a sheet-pressing plate 32, a sheet-feeding roller 33, a sheet-feeding pad 34, paper dust rollers 35 and 36, and a pair of registration rollers 37. The sheet tray 31 is detachably mounted in the main casing 2, and the sheet-pressing plate 32 is pivotably movably provided within the sheet tray 31. The sheet-feeding roller 33 is disposed above and forward of the sheet tray 31.

In the sheet accommodation section 3, each sheet P is urged upward to reach the sheet-feeding roller 33 by the sheet-pressing plate 32, conveyed by the sheet-feeding roller 33 and the sheet-feeding pad 34 while being pinched therebetween, transmitted to the registration rollers 37 via the paper dust rollers 35 and 36, and then conveyed to the process cartridge 5.

The exposure device 4 is disposed in an upper portion of the main casing 2. The exposure device 4 includes a laser emission section (not shown), a rotatable polygon mirror 41, lenses 42 and 43, and reflection mirrors 44, 45 and 46. The laser emission section emits a laser beam based on image data. After being reflected off or passing through the polygon mirror 41, the lens 42, the reflection mirrors 44 and 45, the lens 43 and the reflection mirror 46 in this order, the laser beam scans a surface of a photosensitive drum 61 (described later) at a high speed, as shown by a dotted chain line in FIG. 1.

The process cartridge 5 is disposed below the exposure device 4. The process cartridge 5 is detachably mounted in the main casing 2 through the opening when the front cover 21 is opened. The process cartridge 5 includes a drum cartridge 6 and a developing cartridge 7.

The drum cartridge 6 includes a drum casing 60 constituting an outer frame of the drum cartridge 6. Within the drum casing 60, a photosensitive drum 61, a charger 62, a transfer roller 63 and a cleaning brush 64 are provided.

The photosensitive drum 61 is rotatably supported to the drum casing 60. The photosensitive drum 61 includes a cylindrical drum main body having conductive characteristics whose circumferential surface is covered with a photosensitive layer with charging properties.

The charger 62 is disposed above and in opposition to the photosensitive drum 61 with a space kept therebetween so that the charger 62 and the photosensitive drum 61 can be spatially separated from each other. The charger 62 spans along an axial direction of the photosensitive drum 61, and has a charging wire 62A that applies stepwise voltages (charging bias) to generate a corona discharge for uniformly charging the surface of the photosensitive drum 61. A grid electrode may or may not be provided in the charger 62.

The transfer roller 63 is also rotatably supported to the drum casing 60. The transfer roller 63 is disposed below and in contact with the photosensitive drum 61. A transfer bias is applied to the transfer roller 63 for transferring a toner image formed on the photosensitive drum 61 onto the sheets P.

The cleaning brush 64 is disposed in opposition to and in contact with the photosensitive drum 61 at a position rearward of the photosensitive drum 61. A cleaning bias is applied to the cleaning brush 64 during cleaning operations or development operations, thereby removing toner remaining on the surface of the photosensitive drum 61 and paper dust of the sheets P deposited thereon.

The developing cartridge 7 is detachably mounted in the drum cartridge 6 (the drum casing 60). The developing cartridge 7 has a developing casing 70 within which a developing roller 71, a supply roller 72, a thickness-regulating blade 73 and a toner accommodation section 74 are provided.

The developing roller 71 is disposed in opposition to and in contact with the photosensitive drum 61 at a position forward of the photosensitive drum 61. The developing roller 71 supplies toner to an electrostatic latent image formed on the surface of the photosensitive drum 61. A developing bias VD is applied to the developing roller 71 during development operations.

The supply roller 72 is disposed so as to be in contact with the developing roller 71 for supplying toner thereto at a position forward of the developing roller 71. The thickness-regulating blade 73 slidingly contacts the developing roller 71 and controls thickness of toner carried on the surface of the developing roller 71. The toner accommodation section 74 is arranged at a position forward of the supply roller 72 for accommodating toner. An agitator 74A is provided within the toner accommodation section 74 for agitating the toner accommodated therein as well as for supplying the toner to the supply roller 72.

In the process cartridge 5 having the above-described configuration, the charger 62 (the charging wire 62A) applies a charging bias V1 to the surface of the photosensitive drum 61 uniformly. Subsequently, the high-speed scanning of the laser beam emitted from the exposure device 4 exposes the surface of the photosensitive drum 61, lowering a potential of the scanned area. As a result, an electrostatic latent image is formed on the surface of the photosensitive drum 61 based on image data.

In the meantime, the toner within the toner accommodation section 74 is supplied to the supply roller 72, and subsequently to the developing roller 71 when the developing roller 71 and the supply roller 72 are in contact with each other. In accordance with rotation of the developing roller 71, the toner is then carried on the surface of the developing roller 71 as a thin layer of uniform thickness because of the thickness-regulating blade 73. While the developing roller 71 rotates, the toner carried on the developing roller 71 is then supplied to the electrostatic latent image formed on the surface of the photosensitive drum 61. In this way, a visible toner image is formed on the surface of the photosensitive drum 61. When the sheet P is conveyed between the photosensitive drum 61 and the transfer roller 63, the toner image is transferred onto the sheet P.

The fixing section 8 is disposed at a position rearward of the process cartridge 5 (downstream in a sheet conveying direction). The fixing section 8 includes a heat roller 81, a pressure roller 82 disposed in opposition to the heat roller 81 and a pair of conveyor rollers 83. While the sheet P passes between the heat roller 81 and the pressure roller 82, the toner transferred onto the sheet P is thermally fixed on the sheet P. The sheet P is then conveyed by the conveyor rollers 83, and finally discharged onto the sheet discharge tray 23 by a pair of discharge rollers 22 provided on the main casing 2.

The main motor 9 is a well-known motor that transmits driving force, via a transmission mechanism (not shown), to each section of the laser printer 1, such as the sheet-feeding roller 33, the photosensitive drum 61, the transfer roller 63, the developing roller 71, the agitator 74A and the heat roller 81. The main motor 9 is disposed appropriately within the main casing 2.

The control device 10 is suitably disposed within the main casing 2 and includes components not shown in FIG. 1, such as a CPU, a RAM, a ROM and an input-output circuit. The control device 10 controls operations of the laser printer 1 in accordance with programs and data stored in the ROM and outputs from a sensor (not shown).

Next, how the control device 10 controls image forming operations in the laser printer 1 will be described with reference to FIGS. 2 to 4. Note that, a time-chart of FIG. 3 illustrates timings, not exact time, at which each voltage is applied and the main motor is driven. Also note that, toner used in the present embodiment is assumed to be positively charged and therefore tends to move toward a side whose potential is lower.

Figure 2:
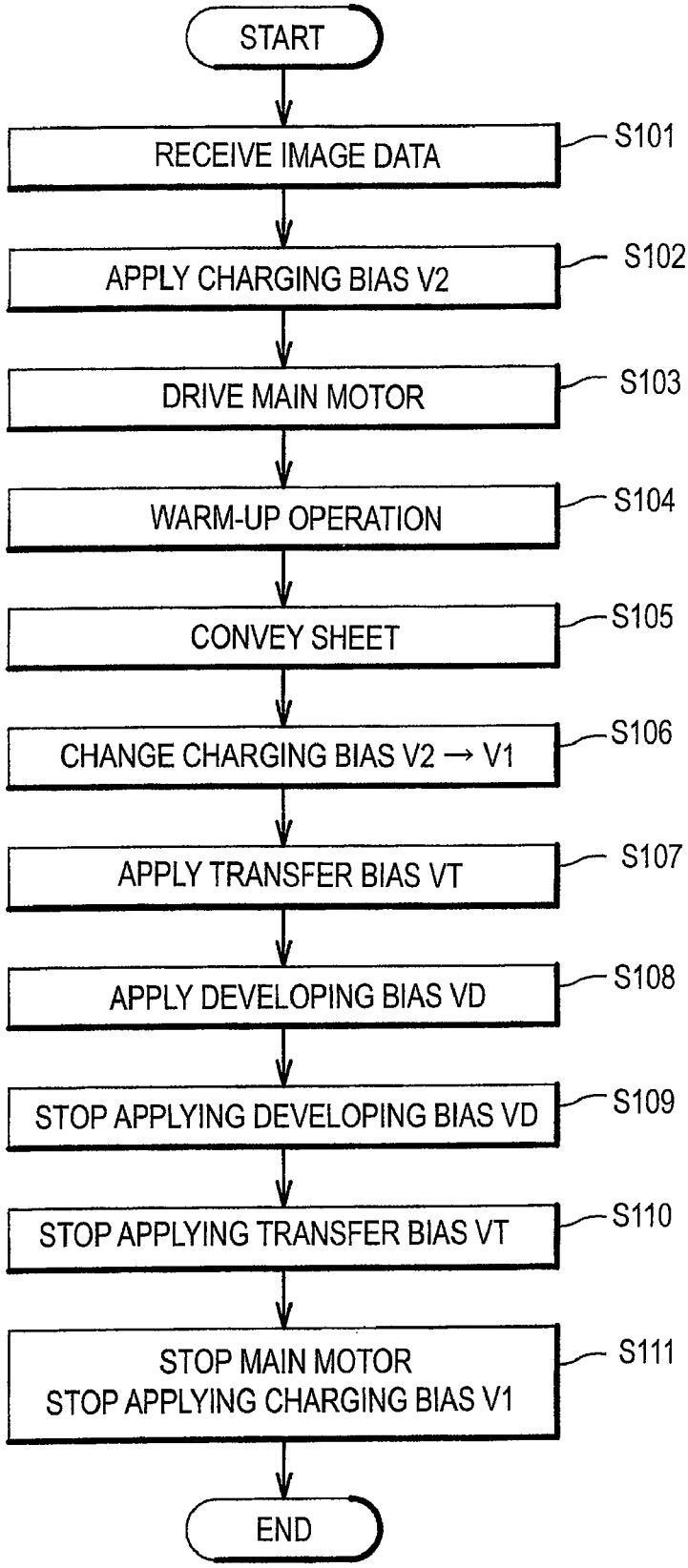
FIG. 2 is a flowchart showing steps of an image forming operation controlled by a CPU of the laser printer.
Figure 3:
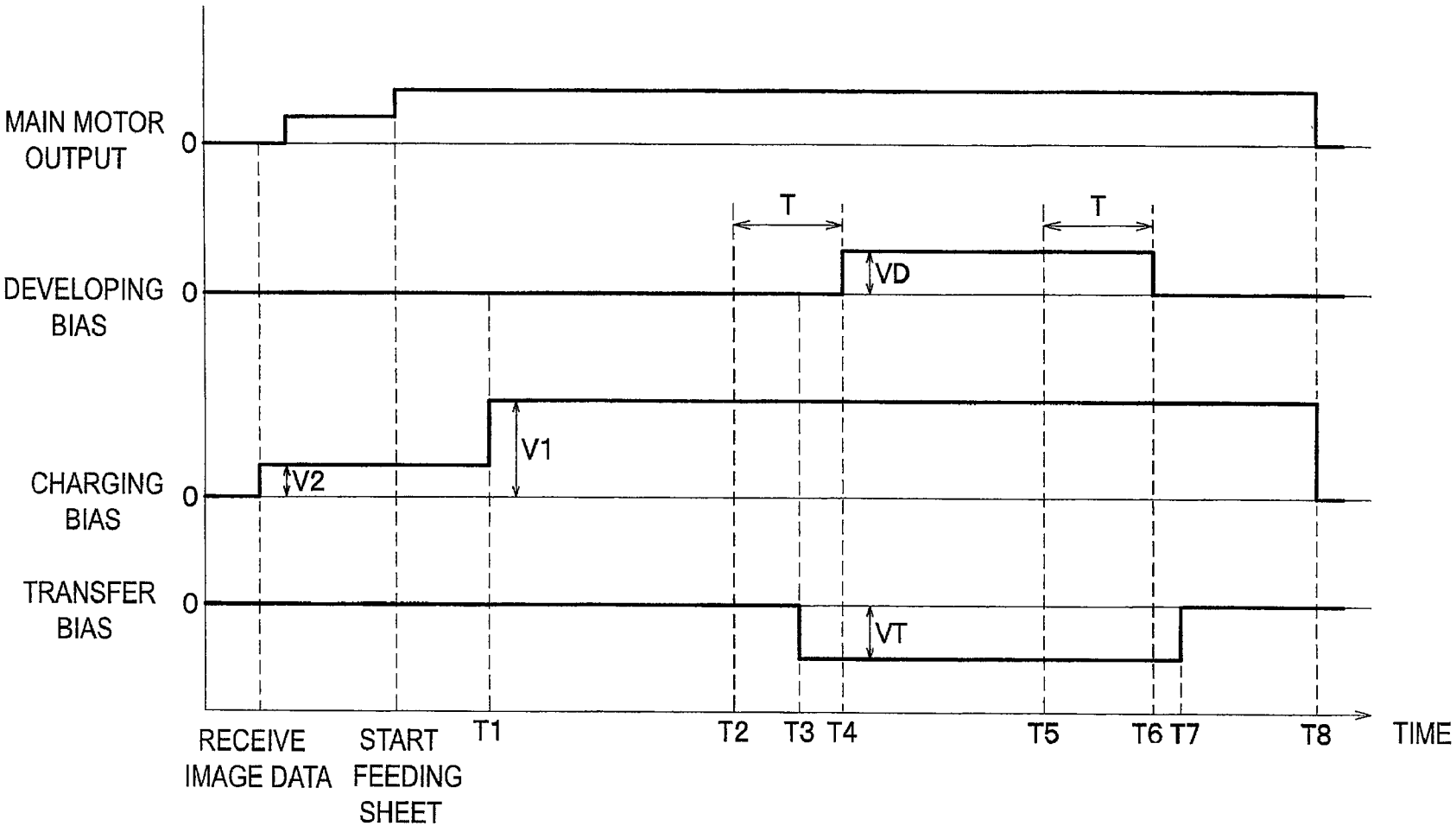
FIG. 3 is a time-chart showing how voltages are applied to a developing roller, a charging wire and a transfer roller, along with output states of a motor.

As shown in FIGS. 2 and 3, when a personal computer (not shown) connected to the laser printer 1 transmits a command requesting to print together with image data, the control device 10 receives the image data (S101). Upon receipt of the image data, the control device 10 starts to apply a charging bias V2 to the charging wire 62A (S102). The charging bias V2 is set to be lower than the charging bias V1, which is applied to the charging wire 62A during development, as well as to be higher than a surface potential of the developing roller 71 carrying positively charged toner thereon.

The control device 10 then starts driving the main motor 9 (S103), resulting in rotation of the photosensitive drum 61. At this time, the surface of the photosensitive drum 61 is charged by the charging wire 62A to which the charging bias V2 is applied. The charging bias V2 is higher than the surface potential of the developing roller 71. As a result, electrical attraction of toner to the photosensitive drum 61 can be suppressed, thereby preventing the surface of the photosensitive drum 61 from being contaminated by the toner before development.

The control device 10 then executes warm-up operations before development for a predetermined period of time (S104). Warm-up operations may include controlling the agitator 74A to agitate toner within the toner accommodation section 74 and to supply the toner to the supply roller 72, and supplying power to a heating source of the heat roller 81. The control device 10 then electrically connects the main motor 9 and the sheet-feeding roller 33 via a transmission mechanism (not shown). As the main motor 9 powers up, the sheet-feeding roller 33 are made to rotate. In this way, the sheets P accommodated in the sheet tray 31 start to be fed (S105).

Subsequently, the control device 10 changes the charging bias applied to the charging wire 62A from the charging bias V2 to the charging bias V1 (S106). More specifically, as shown in FIG. 3, the control device 10 steps up the charging bias V2 to the charging bias V1 at a timing T1 in the present embodiment. The period of time from the timing T1 to a timing T4 is a duration for the photosensitive drum 61 to make one turn. Upon uniformly charging the entire surface of the photosensitive drum 61 by the charging wire 62A to which the charging bias V1 is applied, the developing bias VD is applied to the developing roller 71 at the timing T4.

Figure 4:
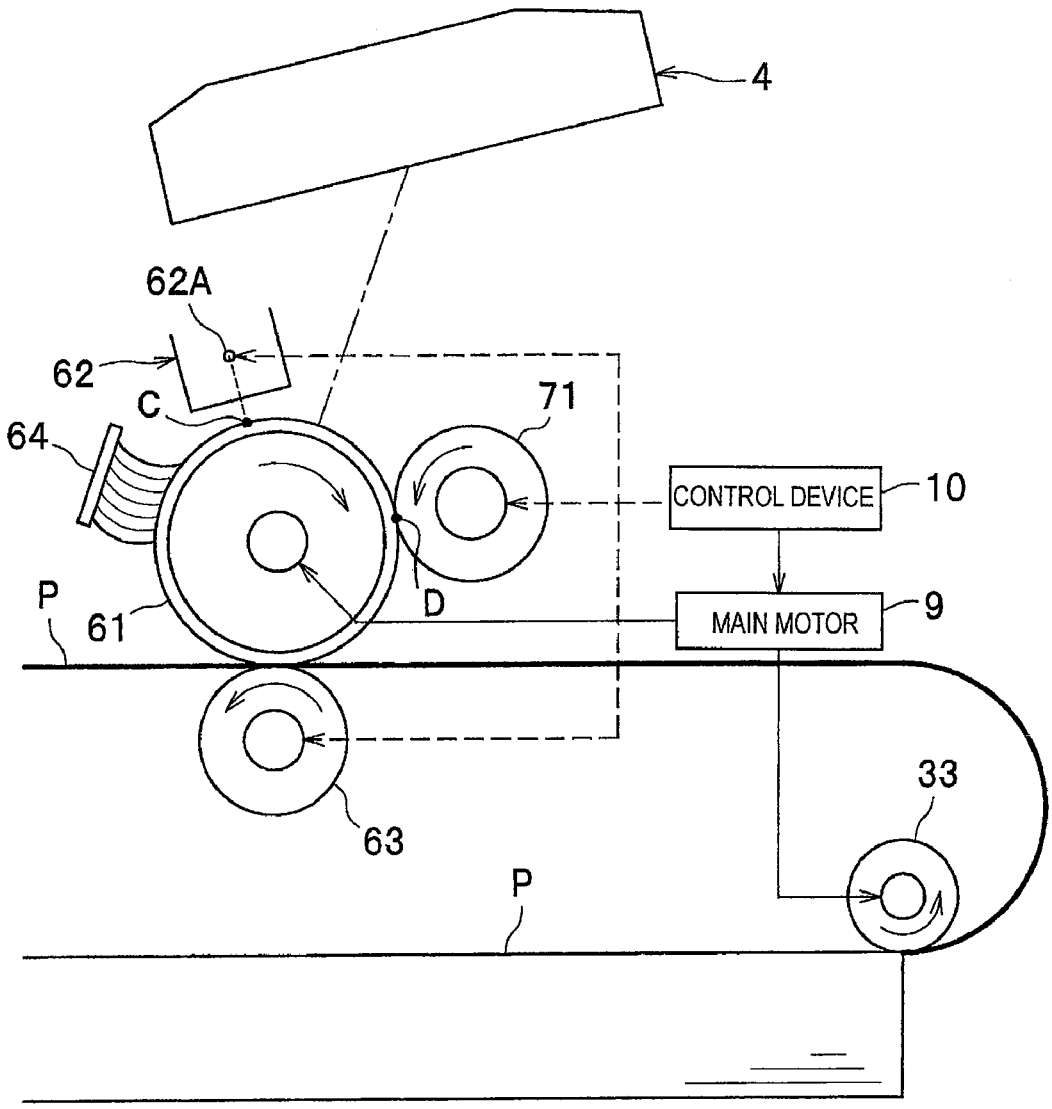
FIG. 4 is a schematic diagram of an essential portion of the laser printer.

Referring to FIG. 4, it is assumed that a position C on the photosensitive drum 61 is immediately below the charging wire 62A at a timing T2 and is moved to a developing position D after expiration of a period of time T from a timing T2 to the timing T4. At the developing position D, the developing roller 71 supplies toner to the surface of the photosensitive drum 61. At some time during the period of time T, the photosensitive drum 61 is exposed to the laser beam emitted from the exposure device 4 to form an electrostatic latent image. When the position C on the photosensitive drum 61 has reached to the developing position D at the timing T4, the developing bias VD is applied to the developing roller 71 to thereby enable development of the latent image.

In this way, the charging bias V2 is stepped up to the charging bias V1 at a timing some time before the timing T2. Therefore, after the developing bias VD has been applied to the developing roller 71 at the timing T4, the developing roller 71 applied with the developing bias VD and the photosensitive drum 61 charged with the charging bias V1 come into contact with each other. In other words, the electrostatic latent image is to be formed on the circumferential surface of the photosensitive drum 61 which has been uniformly charged with the charging bias V1. Hence, compared to a case where the surface of the photosensitive drum 61 has been charged partially with the charging bias V1 and partially with the charging bias V2 when the electrostatic latent image is to be formed thereon, this configuration enables quality of the image to be developed on the sheet P to be high and stable.

Although the charging bias V2 is set to be lower than the developing bias VD (V2<VD) in the present embodiment, the surface of the photosensitive drum 61 has been in a state charged only with the charging bias V1 when brought to development. This configuration can prevent electrical attraction of the toner to non-exposed portions on the surface of the photosensitive drum 61 at the time of development, thereby suppressing degradation in quality of the image transferred on the sheet P.

Preferably, the charging bias V2 should be set higher than the developing bias VD. Under this configuration, toner attraction to the surface (especially to the non-exposed portions on the surface) of the photosensitive drum 61 can be reliably suppressed regardless of the timing at which the charging bias V2 is switched to the charging bias V1. As a consequence, the surface of the photosensitive drum 61 will not be stained with the toner, thereby preventing the image from getting deteriorated.

After the charging bias V2 has been changed to the charging bias V1, the control device 10 applies a transfer bias VT to the transfer roller 63 at a timing T3 (S107). After a predetermined period of time has passed from the timing T3, the control device 10 applies the developing bias VD to the developing roller 71 at the timing T4 (S108). With this application of the developing bias VD, a toner image is formed on the photosensitive drum 61 (development is done) and then transferred onto the sheet P.

The control device 10 then stops applying the developing bias VD at a timing T6 after development has been completed (S109). When the toner image has been transferred onto the sheet P, the control device 10 stops applying the transfer bias VT at a timing T7 (S110). Subsequently, after cleaning the photosensitive drum 61, the control device 10 finally terminates driving the main motor 9 and application of the charging bias V1 at a timing T8 (S111).

Figure 5:
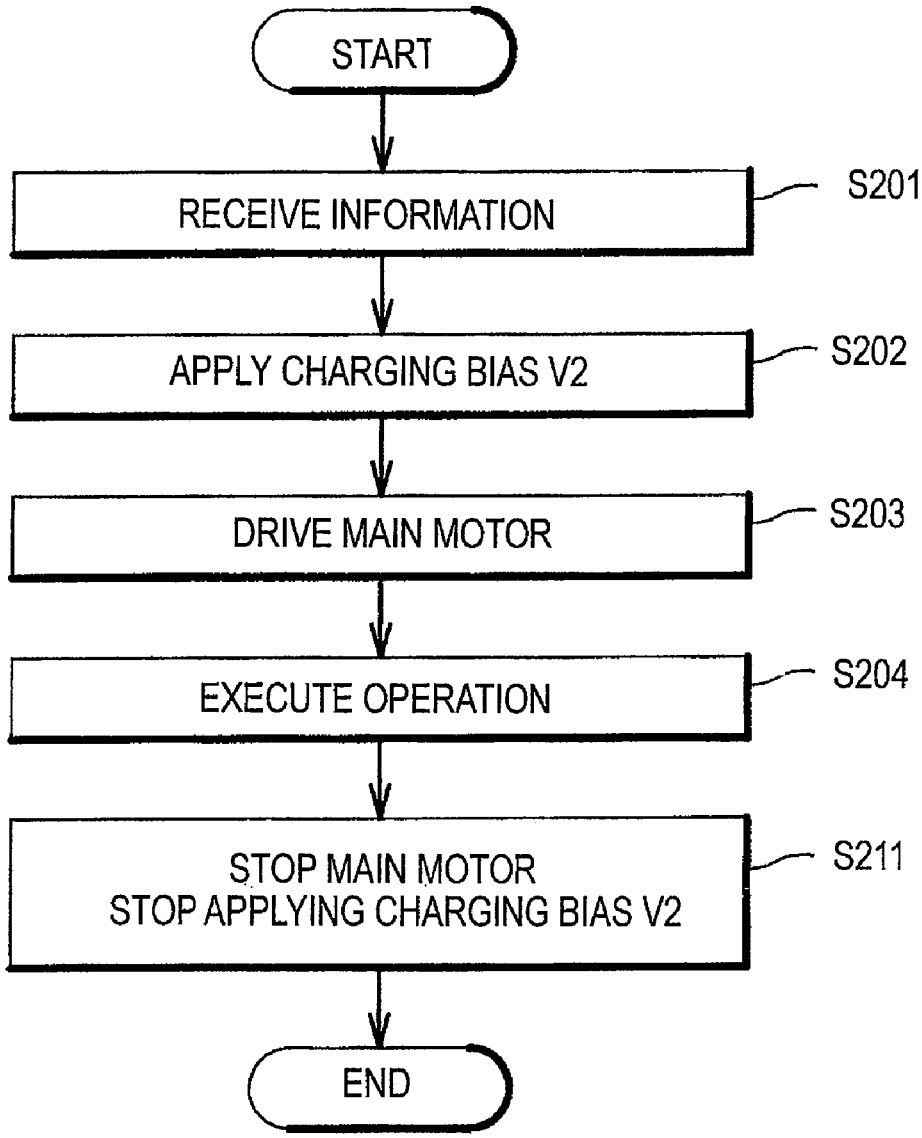
FIG. 5 is a flowchart showing steps controlled by the CPU of the laser printer for warm-up and cleaning operations.

Next, how the control device 10 controls operations of the laser printer 1 during warm-up or cleaning operations will be described with reference to FIG. 5.

Note that the warm-up operations are executed when the laser printer 1 is powered, or when the process cartridge 5 is replaced with new one and the front cover 21 is closed thereafter. The cleaning operations are executed when so instructed by a user. As shown in FIG. 5, when any of the above operations is initiated, the control device 10 receives such information on starting the operation (S201). In response, the control device 10 applies the charging bias V2 to the charging wire 62A (S202).

The control device 10 subsequently starts driving the main motor 9 (S203), thereby rotating the photosensitive drum 61. In this way, the surface of the photosensitive drum 61 is charged with the charging bias V2 which has a potential higher than the surface potential of the developing roller 71.

Since the toner is positively charged in the present embodiment, the surface of the photosensitive drum 61 can be kept away from the toner.

The control device then executes warm-up or cleaning operations for a prescribed period of time in accordance with the received information (S204). Here, the warm-up operations may include instructing the agitator 74A to agitate the toner accommodated in the toner accommodation section 74 and to supply the toner to the developing roller 71. The cleaning operations may include instructing the cleaning brush 64 to clean the surface of the photosensitive drum 61. Once such an operation ends, the control device 10 stops driving the main motor 9 and applying the charging bias V2 (S211).

As described above, according to the laser printer 1 of the present embodiment, the charging bias V1 is applied to the charging wire 62A during an image formation from the timing T1 to the timing T8, while the charging bias V2, which has the potential lower than the charging bias V2, is applied to the charging wire 62A for a period of time other than the image forming period. With this configuration, the current flowing into the charging wire 62A can be decreased. As a result, such decreased current contributes to prevention of foreign matters from being attached to the charging wire 62A, leading to prolonging life of the charging wire 62A.

Further, since the charging bias V2 is set to be lower than the developing bias VD in the present embodiment, the current flowing into the charging wire 62A can be made even smaller, thereby preventing attraction of foreign matters to the charging wire 62A. As a consequence, the life of the charging wire 62A can be made even longer.

While the present invention has been described in detail with reference to the first embodiment thereof, it would be apparent to those skilled in the art that various changes and modifications may be made therein without departing from the spirit of the invention.

In the present embodiment, the charging bias V2 is switched to the charging bias V1 at the timing T1. As a variation, this change in the charging bias may take place at the timing T2. With this configuration, the period of time during which the charging bias V1 (a voltage having an absolute value larger than that of the charging bias V2) is applied to the charging wire 62A can be made even shorter than the present embodiment. As a result, the current flowing into the charging wire 62A can be reduced even more, resulting in further prolongation of life of the charging wire 62A.

Further, as shown in FIG. 3, the charging bias V1 is applied to the charging wire 62A during a period of time from the timing T1 to the timing T8 (including the development period) in the present embodiment. Note that, in the present invention, the development period is specifically meant to span from the timing T2 to the timing T5, i.e. from the timing T4 (when the developing bias VD is applied) minus the period of time T until the timing T6 (when application of the developing bias VD is ended) minus the period of time T. However, as a variation, the charging bias V1 may be applied to the charging wire 62A only during the development period (i.e., from the timing T2 to the timing T5). With this configuration, the current flowing into the charging wire 62A becomes further smaller, leading to much longer life of the charging wire 62A.

Further, instead of the charger 62 provided with the charging wire 62A, there may be employed a so-called sawtooth AC corona charger having needle electrodes arranged in line.

Further, the photosensitive drum 61 is used as an example of photosensitive members in the present embodiment. However, a photosensitive belt may also be employed instead.

Further, a laser is used for exposing the photosensitive drum 61 in the exposure device 4. Alternatively, light emitted from LEDs, EL elements or a fluorescent material may be used for exposing the photosensitive drum 61.

An image forming device according to the present invention encompasses not only a laser printer but also a copier, a multifunctional device or the like. Moreover, an image forming device according to the present embodiment (the laser printer 1) is configured to print in monochrome, but an image forming device that prints colored images may well be applicable to the present invention.

Further, in the present invention, since the positively charged toner is employed, the charging biases V1 and V2, the developing bias VD, and the surface potential of the developing roller 71 are all assumed to have a positive polarity, as shown in FIG. 3. However, as a variation, negatively charged toner may also be used. In this case, the charging biases V1 and V2, the developing bias VD and the surface potential of the developing roller 71 should be of a negative polarity, yet maintaining the absolute value relation described above.

What is claimed is:

1. An image forming device comprising:

a photosensitive member;

a charger that charges the photosensitive member at a charging position;

an exposing unit that exposes the photosensitive member to light and forms an electrostatic latent image on the photosensitive member;

a developing unit that develops the electrostatic latent image formed on the photosensitive member at a developing position, the developing unit having a developing member that carries developer thereon, the developing member having a surface potential, the developer being charged to a polarity; and a control unit that controls the charger so that a first voltage having a first absolute value and a second voltage having a second absolute value are selectively applied to the charger, the first absolute value being greater than the second absolute value, the surface potential of the developing member having a third absolute value smaller than the second absolute value, the control unit applying the first voltage to the charger at least during development while applying the second voltage to the charger during operations other than development, the first voltage, the second voltage and the surface potential having a polarity same as the polarity of the developer.

2. The image forming device as claimed in claim 1, wherein the control unit further applies a developing bias to the developing member, the developing bias having a fourth absolute value greater than the second absolute value, the developing bias having a polarity same as the polarity of the second voltage.

3. The image forming device as claimed in claim 2, wherein the control unit changes the second voltage applied to the charger to the first voltage at a timing A, the timing A being precedent to a timing B at which the control unit applies the developing bias to the developing member by more than a period of time C during which the photosensitive member moves from the charging position to the developing position.

4. The image forming device as claimed in claim 1, wherein the control unit further applies a developing bias to the developing member, the developing bias having a fourth absolute value smaller than the second absolute value, the developing bias having a polarity same as the second voltage.

5. The image forming device as claimed in claim 1, wherein the control unit applies the second voltage to the charger when executing an operation for warming up the photosensitive member.

6. The image forming device as claimed in claim 1, wherein the control unit applies the second voltage to the charger when executing an operation for cleaning the photosensitive member.

7. A method for controlling operations of an image forming device including:

a photosensitive member;

a charger that charges the photosensitive member at a charging position;

an exposing unit that exposes the photosensitive member to light and forms an electrostatic latent image on the photosensitive member; and a developing unit that develops the electrostatic latent image formed on the photosensitive member at a developing position, the developing unit having a developing member that carries developer thereon, the developing member having a surface potential, the developer being charged to a polarity, the method comprising:

applying a first voltage to the charger at least during development, the first voltage having a first absolute value; and applying a second voltage to the charger during operations other than development, the second voltage having a second absolute value smaller than the first absolute value, the surface potential of the developing member having a third absolute value smaller than the second absolute value, the first voltage, the second voltage and the surface potential having a polarity same as the polarity of the developer.

8. The method as claimed in claim 7, further comprising applying a developing bias to the developing member, the developing bias having a fourth absolute value greater than the second absolute value, the developing bias having a polarity same as the second voltage.

9. The method as claimed in claim 8, further comprising switching the second voltage to the first voltage at a timing A, the timing A being precedent to a timing B of applying the developing bias to the developing member by more than a period of time C during which the photosensitive member moves from the charging position to the developing imposition.

10. The method as claimed in claim 7, further comprising applying a developing bias to the developing member, the developing bias having a fourth absolute value smaller than the second absolute value, the developing bias having a polarity same as the second voltage.

11. The method as claimed in claim 7, further comprising applying the second voltage to the charger while the photosensitive member moves for warming up.

12. The method as claimed in claim 7, further comprising applying the second voltage to the charger while the photosensitive member moves for cleaning.

* * * * *